United States Patent [19]

Petillo

[11] 4,304,277

[45] Dec. 8, 1981

[54] REINFORCED HEAD AND NECK ELEMENT FOR A STRINGED INSTRUMENT AND PROCESS OF MANUFACTURE

[76] Inventor: Phillip J. Petillo, 1206 Herbert Ave., Ocean, N.J. 07712

[21] Appl. No.: 231,337

[22] Filed: Feb. 4, 1981

Related U.S. Application Data

[63] Continuation-in-part of Ser. No. 936,381, Aug. 24, 1978, abandoned.

[51] Int. Cl.[3] ..... G10D 3/00; B27M 1/08

[52] U.S. Cl. ..... 144/316; 29/169.5; 29/411; 29/415; 144/318; 144/326 R; 84/293; 156/92; 156/252

[58] Field of Search ..... 29/411, 415, 169.5; 156/91, 92, 252, 250, 267, 268; 144/316, 318, 314 R, 315 R, 313, 326 R; 84/293, 291

[56] References Cited

U.S. PATENT DOCUMENTS

| | | | |
|---|---|---|---|
| 2,795,988 | 6/1957 | Maccaferri | 84/293 |
| 3,538,807 | 11/1970 | Francis | 84/293 X |
| 3,911,778 | 10/1975 | Martin | 84/293 X |
| 3,915,049 | 10/1975 | Bean | 84/293 X |
| 4,084,476 | 4/1978 | Rickard | 84/293 |
| 4,103,583 | 8/1978 | Takabayashi | 84/291 |
| 4,121,492 | 10/1978 | Beradi et al. | 84/293 |
| 4,237,944 | 12/1980 | Todd et al. | 144/318 |

*Primary Examiner*—W. D. Bray

*Attorney, Agent, or Firm*—Stephen W. White

[57] ABSTRACT

A head and neck element for a stringed instrument is disclosed in which opposed, elongated, tension resistant members are separated by a spacer while simultaneously supporting a fingerboard and grip surfaces to produce an integrated element resistant to warping and twisting yet retaining a desirable feel and appearance. Also disclosed is a process of manufacture of a multiplicity of said head and neck elements.

7 Claims, 4 Drawing Figures

REINFORCED HEAD AND NECK ELEMENT FOR A STRINGED INSTRUMENT AND PROCESS OF MANUFACTURE

This application is a continuation-in-part of U.S. Ser. No. 936,381, filed Aug. 24, 1978, now abandoned.

BACKGROUND OF THE INVENTION

1. Field of the Invention

This invention relates to stringed instruments and in particular to those in which the neck includes a reinforcing member and to a unique process for preparing same.

2. Description of the Prior Art

Stringed instruments can be divided into two, basic categories: those which are bowed such as violins and those which are plucked such as guitars and the like. Stringed instruments usually comprise in order a head, a neck and a body. Strings pass from a tension means located in said head, over the neck of the instrument and are finally fastened in the body which serves to provide the resonating chamber for producing sound on the instrument. Both categories of instrument—violins and guitars—suffer from the same problem; i.e. in each, the strings impose large, tensile forces on the neck such that warping and twisting can occur. As the strings are further stretched to tune the instrument—using the head tension means—they impose extensive longitudinal stress over the neck and body of the instrument. If this stress cannot be adequately resisted, warping and twisting of the neck will occur thus producing distorted notes when the instrument is played. In severe cases, the warping and twisting can become so great that the strings will contact undesirable portions of the neck and thereby render the instrument un-playable.

The reinforcing of necks for stringed instruments in order to prevent or substantially reduce warping or twisting of said neck is known in the prior art and has been approached in several ways. In one particular embodiment, a steel rod was imbedded along the entire length of the neck. This was unsatisfactory since the head was not integrally reinforced in this configuration. In yet another prior art system there is described a neck made entirely of extruded aluminum. While necks made of metal are feasible, players of stringed instruments are accustomed to the warm feel of wood and the player is uncomfortable when using a cold, metallic element. Other methods of reinforcing using combinations of elements are also known in the prior art. All of these devices and methods have other draw-backs not solved by the elements provided and cannot fully provide a stringed instrument with little or no warpage under normal use. These prior art reinforcing structures also suffer from the fact that they must be individually made and do not lend themselves to multiple manufacture.

Accordingly, one object of this invention is to provide a reinforced stringed instrument that is substantially resistant to neck warpage and twisting when the strings of said instrument are under full tension.

Another object of this invention is to provide said stringed, reinforced element without sacrificing any of the tactile aesthetics of the instrument.

Yet another object of this invention is to provide a quick and easy method for the manufacture of multiple, stringed, reinforced instruments, said process being easy and inexpensive.

SUMMARY OF THE INVENTION

In this invention, a reinforced, non-warping neck and head assembly useful in a stringed instrument is provided using a method of manufacture comprising the steps of:

- joining at least two, parallel reinforcing members on either side of a non-metallic spacer member, between grip members to form a unitary structure;
- cutting said unitary structure longitudinally to form at least two, integral head and neck blocks;
- trimming said blocks to form hand grips thereby finishing said element suitable for accepting finger boards thereon.

The integral head and neck assembly made by this process is useful with any stringed instrument and is strong, reinforced, easy to manufacture and substantially resistant to warping and twisting when strings are installed thereon.

A better understanding of this invention and its unique features and process will be more readily apparent from the following detailed description and from the drawings attached hereto.

DETAILED DESCRIPTION OF THE INVENTION

Figure 1:
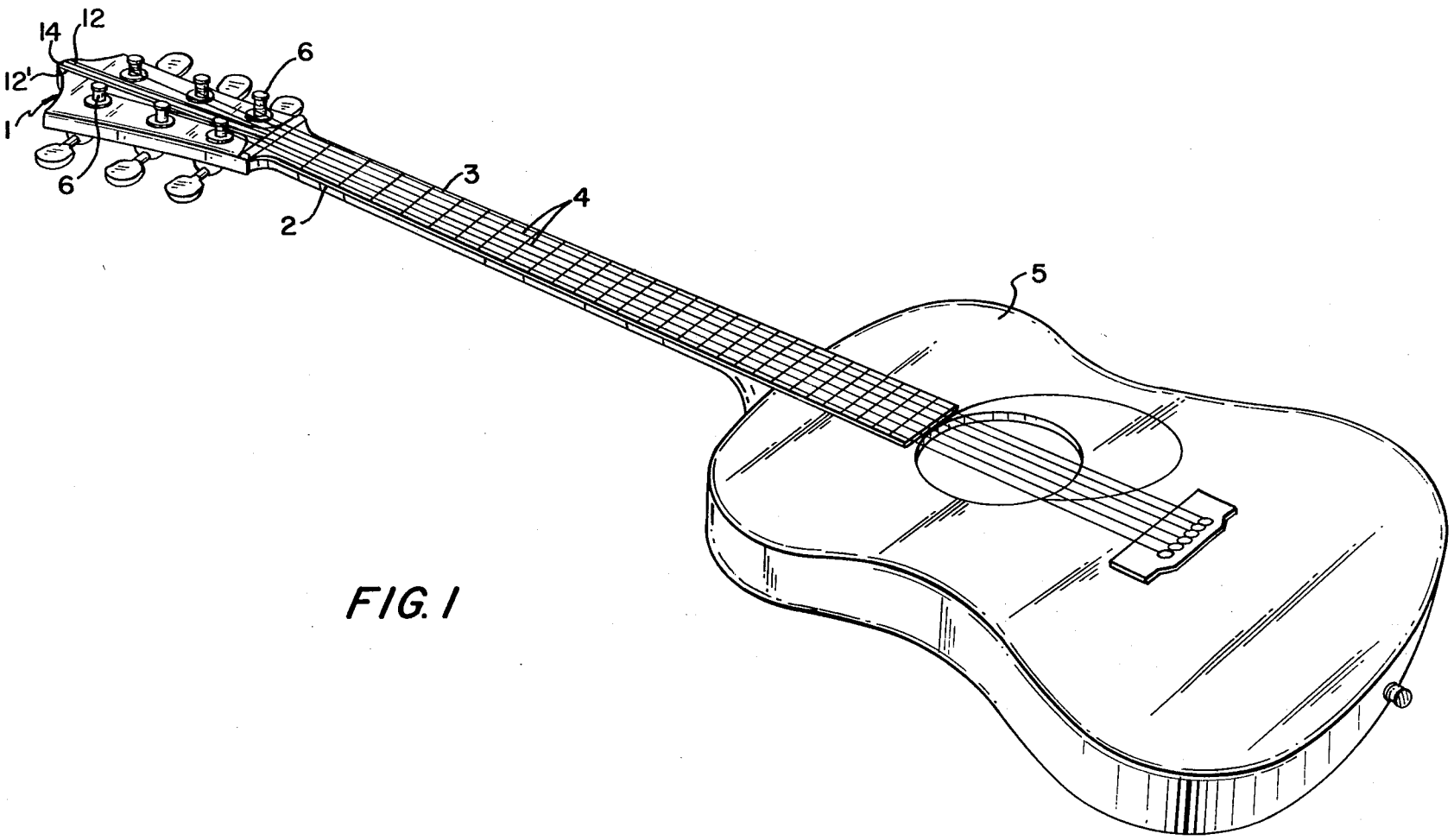
FIG. 1 is an overall view of a guitar stringed instrument having the integral, reinforced head and neck assembly of this invention.

Referring now to FIG. 1 showing the finished reinforced neck and head assembly of this invention in use with a guitar, 1 is the head, 2 is the neck, 3 is a fingerboard, 4 shows the strings, 5 is the body and 6 a string tensioning means. Reinforcing members 12, 12' and the spacer member 14 are shown passing longitudinally through the head. Since fingerboard 3 is in place, neither the reinforcing members nor the spacer can be seen further in this figure.

Figure 2:
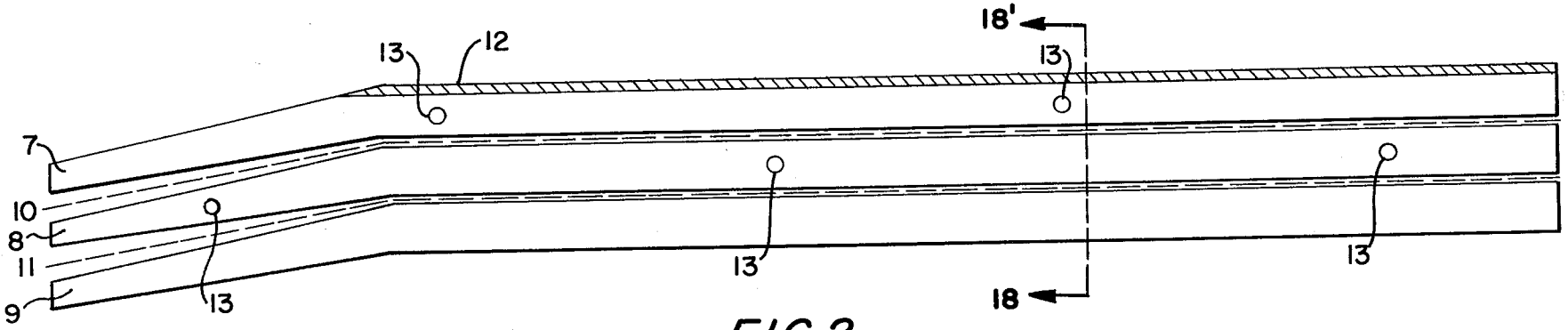
FIG. 2 is a side view of the unitary structure from which the integral, reinforced head and neck assemblies of this invention are manufactured.

FIG. 2 particularly describes the manufacturing method of this invention. This is a side view of the unitary structure showing three (3) head and neck assemblies being cut therefrom along the dashed lines 10 and 11. These three (3) assemblies are labelled 7, 8 and 9. Also shown are pin assemblies 13 which are a particularly preferred embodiment in this process. These pins permit the easy joining and alignment of the reinforcing members, spacer and grip members prior to a gluing step whereby the entire unit is permanently fastened together.

Figure 3:
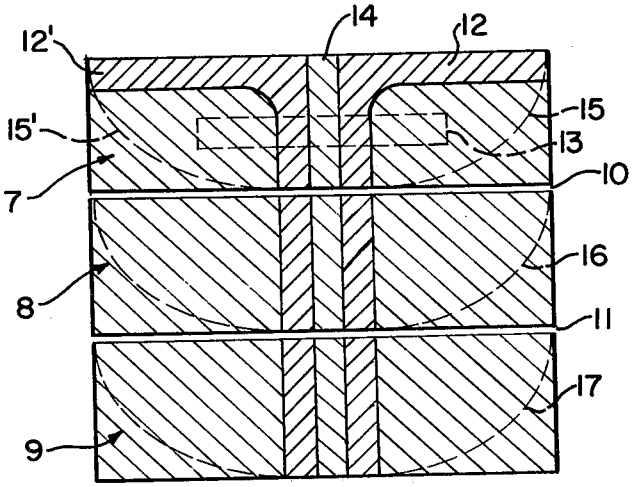
FIG. 3 is a side view taken through 18, 18' of FIG. 2.

FIG. 3 is a side view of FIG. 2 taken along the lines 18, 18'. In this view, which is a preferred embodiment, the reinforcing members 12, 12' are shown to be "L" shaped angles on either side of spacer 14. Grip members 7, 8, and 9 are fashioned for each element when cuts are made along 10 and 11. The grip members may be fashioned to shape by further cutting along dashed lines 15, 16 and 17, for example.

Figure 4:
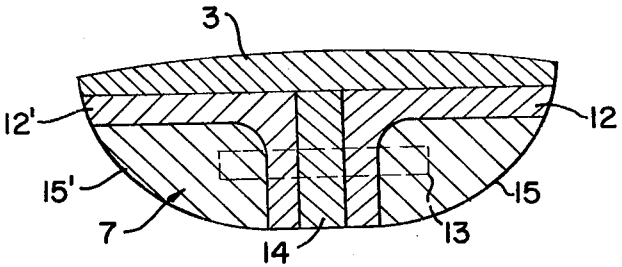
FIG. 4 is one of the finished head and neck assemblies made from a portion of FIGS. 2 and 3.

FIG. 4 is a continuation of the manufacturing process of this invention via FIGS. 2 and 3 and shows the neck fashioned from 7, cut along 10, and further shaped according to dashed line 15 from FIG. 3. Fingerboard 3 has been added.

The reinforcing members 12, 12' are elongated, opposed and parallel on either side of a spacer member 14. The reinforcing members must be resistant to tensile forces so as to resist string tension imparted to the neck and head assembly when said strings are tightened and tuned using, for example, the string tensioning means 6. Advantageously, the reinforcing members may be made of extruded aluminum, magnesium or the like which are stocked, shelf items and reasonably inexpensive. Other materials, however, will work equally well, i.e., plastics, ceramics, etc.

The spacer member 14 may be made of wood, plastic and the like. Similarly, the grip members 15, 15' may also be made of like materials such as wood or plastic. Preferably, the grip members are made from hard woods such as maple, oak, teak or rosewood and are readily trimmable into hand grips.

The reinforcing members the spacer member and the grip members are preferably made from composite, unlike materials which seems to impart a greater resistance to un-wanted warping and/or twisting of the finished product. In practising this invention, by a particularly preferred mode, one may use two pieces of L-shaped aluminum, for example, which are shelf stock material and relatively inexpensive. The spacer member may be plastic and the grip members a hard wood. Several, large portions of these materials are assembled. Holes are advantageously placed in the interior of these elements and pins 13 inserted therein. This permits easy alignment of the entire structure while assembling the various pieces prior to applying glue or some other fastening means. After aligning the various components using the pins, it is preferred to use glue to permanently join these components to each other. After the glue has dried, cuts may be made in the composite to form a multiplicity of head and neck assemblies for use with stringed instruments. For example, in FIG. 2, the composite shown is sufficient to make three (3) head and neck assemblies. If it is desired to make yet more, larger pieces of the elements would be required. A unique feature of this process is that the head can be cut at the same time the neck is cut permitting the integral reinforcing of both parts of this assembly. After the cuts are made, the grip members are shaped to permit gripping by the hands. A variety of shapes may be achieved. Conventionally, the grip members are shaped semi-circularly as shown in the drawings. After shaping, a fingerboard is applied to each neck portion, the structure is mounted on a body of a stringed instrument, tensioning means are placed in the head and strings are laid from said tensioning means, over the fingerboard along the neck and are finally fastened on the body as is conventional. When these strings are tightened, the reinforced structure is substantially resistant to the tensile forces which are thereby created. The element provided in the practise of this invention is unique since both head and neck are integrally reinforced. No prior art element can make such a claim since they do not follow the process of manufacture described here.

Other embodiments which are envisioned within the ambit of this invention include fabricating the reinforcing members in various shapes. It is not important as to what shape the reinforcing members take, only that they be disposed on either side of the spacer and longitudinally placed along the head and neck portions of the entire assembly. Disclosed are L-shaped, U-shaped or V-shaped but others may be used conveniently as well known to those skilled in the art. Extruded aluminum is convenient and readilly available but cast metals, ceramics and the like may also be used. The spacer may be made from plastic, wood, ceramic, etc. Preferentially, the spacer member is made from plastic or wood. Structurally, if the entire block assembly is made of different materials, the whole element will be stronger.

In yet another embodiment envisoned within the ambit of this invention the reinforcing members may be provided with raised portions of like material along the various surfaces. One then needs to route out the grip members in the appropriate areas in order to receive the raised portions of the reinforcing members. This embodiment provides more gluing surface between the reinforcing and grip members.

In place of pins, other similar elements may be used to facilitate alignment of the entire structure and to assist in the gluing or adhering process. For example, screws may be placed through the grips and into the reinforcing and spacer members. Of course, in this embodiment, the screws would be counter-sunk and filled prior to finishing.

The spacer member may be of a variety of elements as stipulated above. If sufficient adhesive is used between the reinforcing members, this adhesive will function as a spacer member when dried.

In summary, by using individual reinforcing members to form a composite reinforcing element, undesirable stress is eliminated without the use of forging or casting the head and neck assembly while gaining simplified manufacturing techniques and without losing the desirable feel of wood or the like. Accordingly, a technique has been disclosed whereby a head and neck assembly resistant to warping and twisting yet having a warm feel can readily be achieved in an efficient and simple manufacturing technique. While only preferred embodiments have been disclosed, along with the best mode contemplated by the inventor at the time of this invention, and as shown in the drawings, it will be readily recognized that they are merely representative of the principles of the invention and other modes and embodiments will readily occur to those skilled in the art and which will fall within the scope of this invention.

I claim:

1. In a method for fabricating a head and neck assembly for a stringed, musical instrument comprising the steps of:

joining at least two, parallel reinforcing members on either side of a spacer member;

aligning grip members longitudinally on either side of said reinforcing members to form a unitary structure therefrom;

cutting said unitary structure longitudinally to form at least two, integral head and neck blocks therefrom;

trimming each of said blocks longitudinally along said grip members thereby finishing said assembly suitable for accepting fingerboards thereon.

2. The method of claim 1 wherein holes are drilled through said reinforcing members and said spacer member and said grip members and pins are inserted therein to assist in said alignment step.

3. The method of claim 2 wherein glue is applied between said reinforcing members, and said spacer member and said grip members and said assembly is dried prior to cutting said unitary structure in to at least two, integral head and neck blocks.

4. The method of claim 3 wherein said reinforcing members are comprised of metallic, ceramic or other stress resistant material and said spacer member is plastic.

5. The method of claim 4 wherein said reinforcing members are extruded aluminum and said grip members are wood.

6. The method of claim 5 wherein said reinforcing members are L-shaped in cross-section and said blocks are trimmed in a semi-circular manner.

7. The method of claim 6 wherein said L-shaped reinforcing members are disposed in opposed relationship and either side of said spacer member so that one neck block cut longitudinally therefrom has opposed L-shaped reinforcing members therein and the other has opposed rectangular shaped reinforcing members therein when said unitary structure is viewed cross-sectionally.

* * * * *